United States Patent [19]

Teramura et al.

[11] 4,443,388

[45] Apr. 17, 1984

[54] DEVICE FOR ADJUSTING THE DEGREE OF OPENING OF THE THROTTLE VALVE OF A CARBURETOR

[75] Inventors: Mitsuyoshi Teramura; Masatami Takimoto, both of Toyota; Norihiko Nakamura, Mishima; Takaaki Itoh, Mishima; Takashi Katou, Mishima; Toshiharu Morino, Mie; Youzou Sakakibara, Kariya, all of Japan

[73] Assignees: Toyota Jidosha Kabushiki Kaisha, Toyota; Aisan Industry Co., Ltd., Obu, both of Japan

[21] Appl. No.: 417,868

[22] Filed: Sep. 14, 1982

[30] Foreign Application Priority Data

Dec. 22, 1981 [JP] Japan ..... 56-206056

[51] Int. Cl.[3] ..... F02M 3/06

[52] U.S. Cl. ..... 261/39 A; 261/44 C; 261/65

[58] Field of Search ..... 261/39 A, 44 C, 65, 261/52

[56] References Cited

U.S. PATENT DOCUMENTS 3,740,040 6/1973 Brown ..... 261/39 A
3,807,709 4/1974 Suda et al. ..... 261/39 A
3,956,434 5/1976 Dickensheets et al. ..... 261/44 C
4,311,653 1/1982 Kushida ..... 261/65
4,351,782 9/1982 Bellicardi et al. ..... 261/39 A

FOREIGN PATENT DOCUMENTS 2926843 7/1980 Fed. Rep. of Germany ..... 261/65

*Primary Examiner*—Tim R. Miles
*Attorney, Agent, or Firm*—Finnegan, Henderson, Farabow, Garrett & Dunner

[57] ABSTRACT

A device for adjusting the degree of opening of the throttle valve of a carburetor comprising a cam pivotally mounted on a pivot. The cam is actuated by a wax valve and rotated in accordance with an increase in the temperature of the cooling water of the engine. The cam has a cam face which is engageable with a lever connected to the throttle valve for retaining the throttle valve at a predetermined fast idling degree during engine warm-up. An auxiliary lever is pivotally mounted on the pivot. The auxiliary lever has an outer circumferential face which is engageable with the lever of the throttle valve for retaining the throttle valve at the predetermined fast idling degree after completion of engine warm-up.

10 Claims, 6 Drawing Figures

DEVICE FOR ADJUSTING THE DEGREE OF OPENING OF THE THROTTLE VALVE OF A CARBURETOR

BACKGROUND OF THE INVENTION

The present invention relates to a device for adjusting the degree of opening of the throttle valve of a carburetor.

In order to promote engine warm-up, a carburetor has been known which comprises a lever fixed onto the valve shaft of the throttle valve, a cam engaging with the tip of the lever and retaining the throttle valve at the fast idling position, and a cam actuating device for rotating the cam about the rotating axis thereof in response to a change in the engine temperature. In this carburetor, the throttle valve is gradually closed by rotating the cam in accordance with an increase in the engine temperature. In such a conventional carburetor, since the degree of opening of the throttle valve has a great influence on the engine operation during engine warm-up, it is necessary to adjust the throttle valve so that the degree of opening of the throttle valve when the carburetor is assembled to the engine becomes precisely equal to a predetermined fast idling degree.

During engine warm-up, however, the engine temperature and the engine cooling water temperature continuously rise. Under such conditions, it is difficult in practice to adjust the degree of opening of the throttle valve to the degree appropriate to, for example, the engine cooling water temperature.

Contrary to this, when the engine warm-up is completed, the engine operation becomes stable. If the throttle valve were then opened to the fast idling position and the degree of opening of the throttle valve were then adjusted so that the engine speed became equal to the predetermined speed, it would be possible precisely to adjust the fast idling degree of the throttle valve uniformly for all engines. In a conventional carburetor, however, when the engine warm-up is completed, the cam is disengaged from the lever fixed onto the valve shaft of the throttle valve. Thus, it is impossible to adjust the fast idling degree of opening of the throttle valve.

SUMMARY OF THE INVENTION

An object of the present invention is to provide a device for adjusting the degree of opening of the throttle valve, which is capable of adjusting the fast idling degree of opening of the throttle valve after completion of engine warm-up.

According to the present invention, there is provided a device for adjusting the degree of opening of the throttle valve of a carburetor having a valve shaft which supports the throttle valve, said device comprising: a housing; a pivot mounted on said housing; a throttle lever mounted on the valve shaft and being rotatable with the throttle valve; a cam pivotally mounted on said pivot and having a cam face which is engageable with said throttle lever during engine warm-up for retaining the degree of opening of the throttle valve at a predetermined fast idling degree; actuating means for rotating said cam in response to a change in the engine temperature and disengaging said throttle lever from said cam when the engine temperature is higher than a predetermined temperature for closing the throttle valve to an idling position; and an auxiliary lever pivotally mounted on said pivot and having an outer peripheral face which is engageable with said throttle lever for retaining the degree of opening of the throttle valve at the predetermined fast idling degree.

The present invention may be more fully understood from the description of a preferred embodiment of the invention set forth below, together with the accompanying drawings:

DESCRIPTION OF A PREFERRED EMBODIMENT

Figure 1:
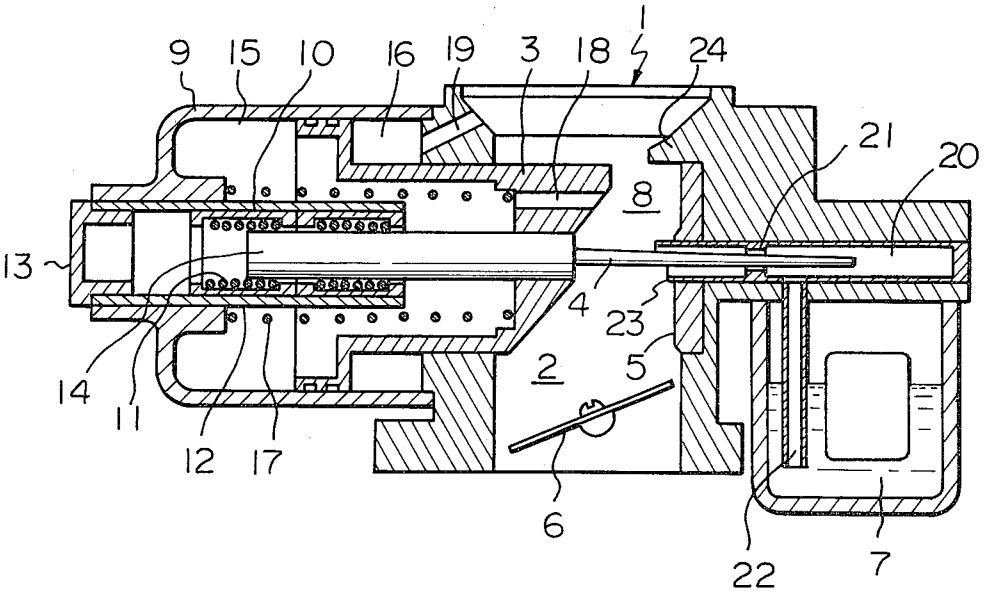
FIG. 1 is a cross-sectional side view of a variable venturi-type carburetor.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1. A guide sleeve 10, extending within the casing 9 in the axial direction thereof is attached to the casing 9. A bearing 12, equipped with a plurality of balls 11, is inserted into the guide sleeve 10, and the outer end of the guide sleeve 10 is closed with a blind cap 13. A guide rod 14 is fixed onto the suction piston 3 and is inserted into the bearing 12 so as to be movable in its axial direction. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3. A compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22. Fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21. Fuel is fed into the intake passage 2 from the nozzle 23 after it is metered by an annular gap formed between the needle 4 and the metering jet 21.

A raised wall 24, projecting horizontally into the intake passage 2, is formed at the upper end of the spacer 5. Flow control is effected between the raised wall 24 and the tip end portion of the suction piston 3. When the engine is started, air flows downward within the intake passage 2. At this time, since the air flow is restricted between the suction piston 3 and the raised wall 24, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

Figure 2:
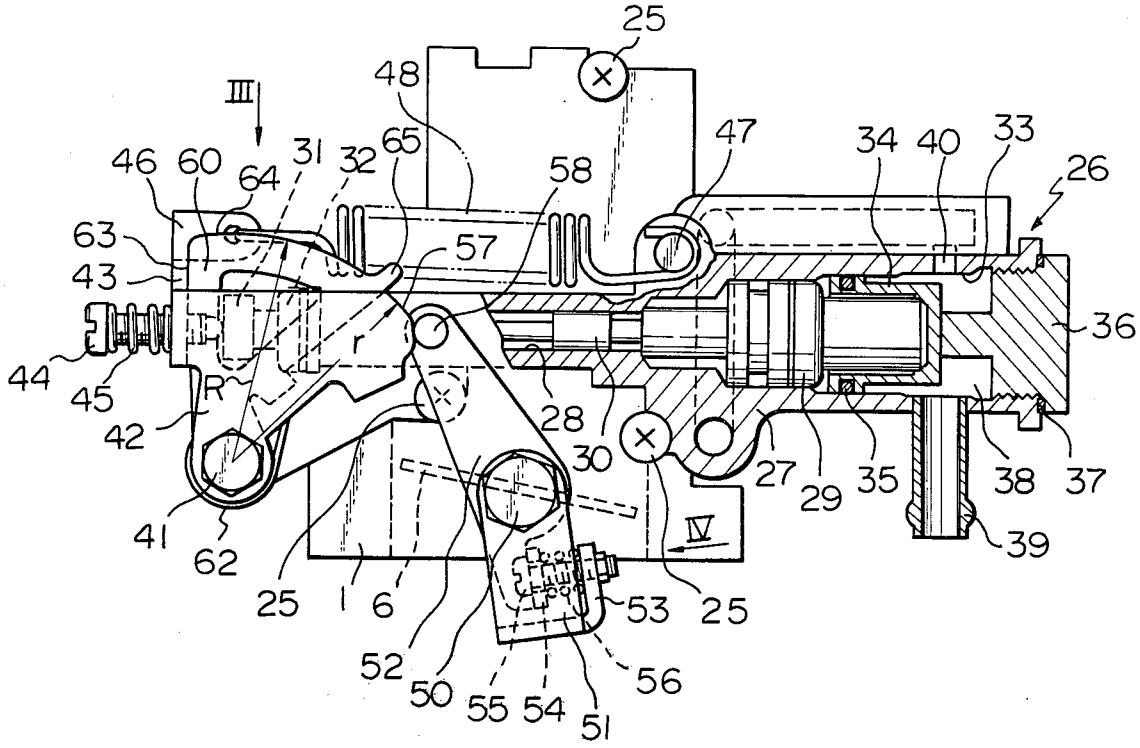
FIG. 2 is a side view, partly in cross-section, of a throttle control valve.

Referring to FIG. 2, a throttle control valve 26 is fixed onto the carburetor body 1 by means of three bolts 25. The throttle control valve 26 comprises a circular bore 28 extending in the longitudinal direction of a housing 27, and a wax valve 29. A push rod 30, driven by the wax valve 29, is slidably inserted into the circular bore 28. The outer end of the enlarged portion 30 projects outwardly from the housing 27. A disc-shaped head 31 is formed in one piece on the projecting tip of the push rod 30. In addition, the projecting outer end of the push rod 30 is surrounded by a seal member 32 mounted on the housing 27. On the other hand, the housing 27 has an increased diameter bore 33 formed therein. A wax valve holder 34 is fitted into the increased diameter bore 33. In addition, an O-ring 35 is inserted between the wax valve holder 34 and the inner wall of the increased diameter bore 33. A plug 36 is screwed into the increased diameter portion 33 and fixed onto the housing 27 via a gasket 37 and, thus, the wax valve 29 is fixed into the housing 27 by means of the plug 36 via the wax valve holder 34. A cooling water chamber 38 is formed between the wax valve holder 34 and the plug 36, and a cooling water feed pipe 39 is connected to the cooling water chamber 38. Cooling water of the engine, fed into the cooling water chamber 38 via the cooling water feed pipe 39, is discharged from a cooling water discharge hole 40 after the cooling water heats the wax valve 29.

Figure 3:
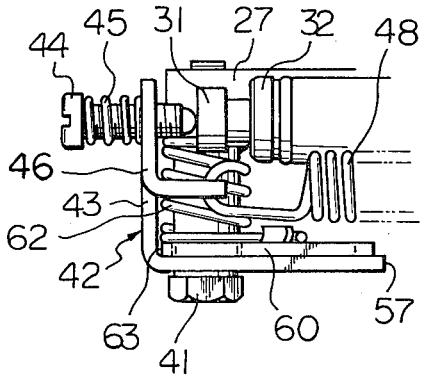
FIG. 3 is a plan view taken along the arrow III in FIG. 2.

Referring to FIGS. 2 and 3, a bolt 41, functioning as a pivot, is secured onto the housing 27, and a cam 42 is pivotally mounted on the bolt 41. The cam 42 has an arm 43 extending in parallel to the bolt 41, and an adjusting screw 44, which is in engagement with the disc-shaped head 31, is screwed into the arm 43. In addition, a compression spring 45, which serves to prevent the adjusting screw 44 from being loosened, is inserted between the arm 43 and the head of the adjusting screw 44. An L-shaped member 46, extending upwardly from the arm 43, is formed in one piece on the arm 43, and a tension spring 48 is arranged between the end portion of the L-shaped member 46 and a pin 47 fixed onto the housing 27 so that the tip of the adjusting screw 44 is continuously pressed in contact with the disc-shaped head 31 of the push rod 30.

Figure 4:
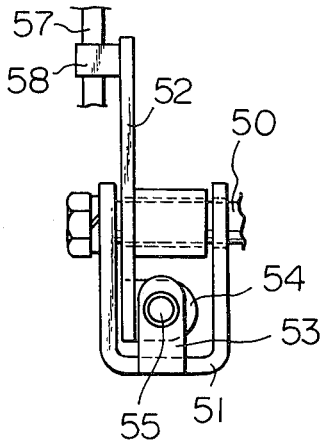
FIG. 4 is a side view taken along the arrow IV in FIG. 2.

On the other hand, as illustrated in FIGS. 2 and 4, a U-shaped arm 51 is fixed onto a valve shaft 50 of the throttle valve 6 and, in addition, a lever 52 is pivotally mounted on the valve shaft 50. An upwardly extending arm 53 is formed in one piece on the lower end of the arm 51, and an arm 54, arranged to face the arm 53, is formed in one piece on the lower end of the lever 52. An adjusting screw 55 is inserted into the bore formed in the arm 54, and the tip of the adjusting screw 55 is screwed into the arm 53. A compression spring 56, which serves to prevent the adjusting screw 55 from being loosened, is inserted between the arms 53 and 54. Consequently, it is possible to adjust the relative position between the lever 52 and the arm 51 by rotating the adjusting screw 55. On the other hand, a pin 58, which is engageable with a cam face 57 of the cam 42, is fixed onto the upper end of the lever 52. As will be understood from FIG. 2, the radius r of the cam face 57, which is measured from the bolt 41, is gradually reduced toward the clockwise direction. An auxiliary lever 60 is pivotally mounted on the bolt 41 at a position located adjacent to the cam 42, and a coil spring 62 inserted around the bolt 41. One end of the coil spring 62 is hooked on the auxiliary lever 60, and the other end of the coil spring 62 is hooked on the housing 27. The auxiliary lever 60 is continuously biased in the counterclockwise direction in FIG. 2 by means of the coil spring 62 so that the peripheral edge 63 of the auxiliary lever 60 abuts against the arm 43 of the cam 42. The outer peripheral face 64 of the auxiliary lever 60 has an arc shape having a fixed radius R which is equal to the maximum radius r of the cam face 57. A radially projecting latch portion 65 is formed on the end portion of the outer peripheral face 64 of the auxiliary lever 60.

Figure 5:
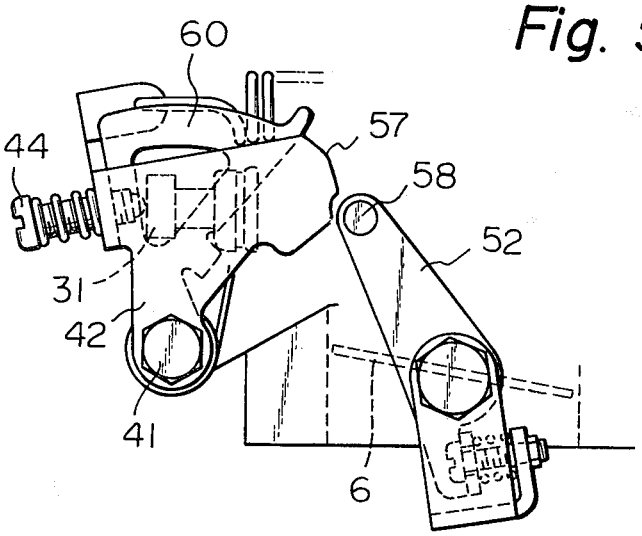
FIG. 5 is a side view of a portion of the carburetor, illustrating the case wherein the lever of the throttle valve is disengaged from the cam.

FIG. 2 illustrates the case where the engine temperature is low, that is, the engine warm-up operation is effected. At this time, since the pin 58 of the lever 52 is in engagement with the cam face 57 of the cam 42, the throttle valve 6 remains open, as illustrated in FIG. 2. Then, since the push rod 30 moves toward the left in FIG. 2 under the operation of the wax valve 29 as the temperature of the cooling water of the engine is increased, the cam 42 is rotated in the counterclockwise direction and, thus, the throttle valve 6 is gradually closed. At this time, the auxiliary lever 60 is also rotated in the counterclockwise direction together with the cam 42. When the temperature of the cooling water of the engine is further increased, the cam 42 is further rotated in the counterclockwise direction and, thus, the pin 58 of the lever 52 is disengaged from the cam face 57 of the cam 42 as illustrated in FIG. 5. As a result of this, the throttle valve 6 is closed to the idling position, and the engine warm-up is completed.

Figure 6:
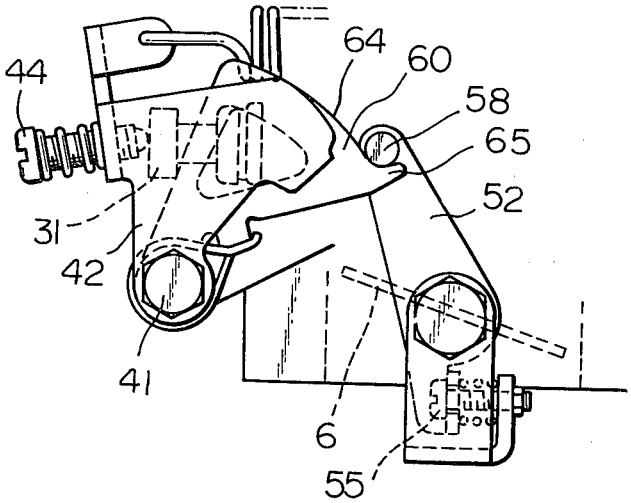
FIG. 6 is a side view of a portion of the carburetor, illustrating the case wherein the auxiliary lever is in engagement with the lever of the throttle valve.

FIG. 6 illustrates a method of adjusting the fast idling degree of opening of the throttle valve 6 after completion of engine warm-up. That is, at first, the auxiliary lever 60 is manually rotated in the clockwise direction and, then, the pin 58 of the lever 52 is engaged with the outer peripheral face 64 of the auxiliary lever 60. At this time, since the pin 58 is engaged with the latch portion 65 of the auxiliary lever 60, the auxiliary lever 60 is retained in a state wherein the outer peripheral face 64 thereof is in engagement with the pin 58. At this time, since the radius R (FIG. 2) of the outer peripheral face 64 of the auxiliary lever 60 is equal to the maximum radius r of the cam face 57, as mentioned above, the lever 52 is located at a position which is the same as the position at which the lever 52 is located at the time of engine warm-up. Then, the degree of opening of the throttle valve 6 is adjusted by rotating the adjusting screw 55 so that the engine speed becomes equal to a predetermined optimum speed. The pin 58 of the lever 52 is disengaged from the latch portion 65 of the auxiliary lever 60 and, as a result, the auxiliary lever 60 is returned to the initial position illustrated in FIG. 5 due to the spring force of the coil spring 62.

According to the present invention, by merely arranging the auxiliary lever on the throttle control device in addition to the cam, it is possible to adjust the fast idling degree of opening of the throttle valve even after completion of engine warm-up. Since it is possible to adjust the throttle valve so that the fast idling degree of opening of the throttle valve becomes precisely equal to a predetermined optimum degree, stable engine warm-up operation can be obtained.

While the invention has been described with reference to a specific embodiment chosen for purposes of illustration, it should be apparent that numerous modifications could be made thereto by those skilled in the art without departing from the basic concept and scope of the invention.

What is claimed is:

1. A device for adjusting the degree of opening of the throttle valve of a carburetor having a valve shaft which supports the throttle valve, said device comprising:

a housing;

a pivot mounted on said housing;

a throttle lever mounted on the valve shaft and being rotatable with the throttle valve;

a cam pivotally mounted on said pivot and having a cam face which is engageable with said throttle lever during engine warm-up for retaining the degree of opening of the throttle valve at a predetermined fast idling degree;

actuating means for rotating said cam in response to a change in the engine temperature and disengaging said throttle lever from said cam when the engine temperature is higher than a predetermined temperature for closing the throttle valve to an idling position; and an auxiliary lever pivotally mounted on said pivot and having an outer peripheral face which is engageable with said throttle lever for retaining the degree of opening of the throttle valve at the predetermined fast idling degree.

2. A device according to claim 1, wherein the cam face of said cam has a radius which is changed along a rotating direction of said cam for gradually closing the throttle valve as the engine temperature is increased, the outer circumferential face of said auxiliary lever having a fixed radius which is equal to the maximum radius of said cam face.

3. A device according to claim 1, wherein said auxiliary lever is manually rotatable from a first position wherein said auxiliary lever cannot engage with said throttle lever to a second position where said auxiliary lever is engageable with said throttle lever.

4. A device according to claim 3, wherein the outer circumferential face of said auxiliary lever has a radially projecting latch portion at one end thereof, said latch portion being engageable with said throttle lever for retaining said auxiliary lever at said second position.

5. A device according to claim 3, wherein said auxiliary lever is spring-loaded for automatically returning said auxiliary lever from said second position to said first position when said throttle lever is disengaged from said auxiliary lever.

6. A device according to claim 5, wherein said cam has an arm which is engageable with said auxiliary lever for retaining said auxiliary lever at said first position.

7. A device according to claim 1, wherein said auxiliary lever is arranged adjacent to said cam, said throttle lever having a pin which is engageable with the outer peripheral face of said auxiliary lever and the cam face of said cam.

8. A device according to claim 1, wherein said device comprises an adjusting apparatus arranged between said throttle lever and the valve shaft for adjusting the relative position between said throttle lever and the throttle valve.

9. A device according to claim 1, wherein said adjusting apparatus comprises an adjusting screw interconnecting said throttle lever to an arm fixed on the valve shaft.

10. A device according to claim 1, wherein said actuating means comprises a wax valve connected to said cam for rotating said cam in response to a change in the temperature of coolant of the engine.

* * * * *